US011828550B2

(12) United States Patent
Underwood et al.

(10) Patent No.: US 11,828,550 B2
(45) Date of Patent: Nov. 28, 2023

(54) POLYMER FIREARM RECEIVER

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 17/717,336

(22) Filed: Apr. 11, 2022

(65) Prior Publication Data

US 2022/0325969 A1 Oct. 13, 2022

Related U.S. Application Data

(60) Provisional application No. 63/172,290, filed on Apr. 8, 2021.

(51) Int. Cl.
*F41A 3/66* (2006.01)

(52) U.S. Cl.
CPC ..... *F41A 3/66* (2013.01)

(58) Field of Classification Search
CPC ..... F41A 3/66
See application file for complete search history.

(56) References Cited

U.S. PATENT DOCUMENTS 3,355,833 A 12/1967 Ruger et al.
4,312,146 A 1/1982 Koon, Jr.
4,539,889 A 9/1985 Glock
D285,236 S 8/1986 Brunton
4,879,827 A 11/1989 Gentry
4,941,394 A 7/1990 Zedrosser et al.
5,632,108 A 5/1997 Ruger et al.
5,913,261 A 6/1999 Guhring et al.
6,070,354 A 6/2000 Burigana et al.
6,298,594 B1 10/2001 Strayer
6,604,311 B1 8/2003 Aney et al.
6,640,479 B2 11/2003 Gühring et al.
7,213,359 B2 5/2007 Beretta
7,814,695 B1 10/2010 Keeney et al.
7,832,326 B1 11/2010 Barrett
8,141,287 B2 3/2012 Dubois
8,230,634 B1 7/2012 Davies et al.
8,316,756 B1 11/2012 Woodell et al.
8,387,296 B2 3/2013 Overstreet et al.
8,464,453 B1 6/2013 Ubl et al.
8,479,635 B2 7/2013 Overstreet et al.
8,789,305 B1 7/2014 DiChario
D713,483 S 9/2014 Firpo et al.
D717,904 S 11/2014 Oglesby
D720,032 S 12/2014 Boutin
8,910,406 B1 12/2014 Huang et al.
9,032,860 B2 5/2015 Faxon
9,052,149 B2 6/2015 Bender
9,068,786 B2 6/2015 DiChario
(Continued)

OTHER PUBLICATIONS

POLYMER 80 UNBOXING; https://www.youtube.com/watch?v=e7JfHbl8_Xw (Year: 2013).*

*Primary Examiner* — Reginald S Tillman, Jr.

(57) ABSTRACT

A receiver blank includes a receiver body with a magazine well and an insert. The insert is located internal to the receiver body, and the insert is manufactured before the receiver body. The insert must be removed from the receiver body to convert the receiver blank to a firearm receiver.

20 Claims, 9 Drawing Sheets

(56) References Cited

U.S. PATENT DOCUMENTS

| | | | | |
|---|---|---|---|---|
| 9,091,499 | B2 | 7/2015 | Overstreet et al. | |
| 9,297,599 | B2 | 3/2016 | Underwood et al. | |
| D760,860 | S | 7/2016 | Vincent et al. | |
| 9,389,033 | B1 | 7/2016 | Underwood et al. | |
| 9,599,419 | B2 | 3/2017 | McGinty | |
| 9,863,730 | B2 | 1/2018 | Elftmann | |
| 9,952,011 | B2 | 4/2018 | Overstreet et al. | |
| 10,018,437 | B2 | 7/2018 | Phipps et al. | |
| 10,180,298 | B2 | 1/2019 | Noonan | |
| 10,184,737 | B2 | 1/2019 | Roberts | |
| 10,415,913 | B2 | 9/2019 | Wyssen | |
| 10,598,454 | B2 | 3/2020 | DiChario et al. | |
| 10,641,563 | B2 | 5/2020 | Song et al. | |
| 10,670,360 | B2 | 6/2020 | Underwood et al. | |
| D943,702 | S | 2/2022 | Underwood et al. | |
| 2004/0002279 | A1* | 1/2004 | Wittenberg | A63H 9/00 446/85 |
| 2005/0011098 | A1 | 1/2005 | Fagundes de Campos | |
| 2006/0207149 | A1 | 9/2006 | Lazor | |
| 2006/0283067 | A1 | 12/2006 | Herring | |
| 2011/0185614 | A1 | 8/2011 | Laney et al. | |
| 2011/0214327 | A1 | 9/2011 | DeSomma | |
| 2012/0023800 | A1 | 2/2012 | Laney | |
| 2012/0111183 | A1 | 5/2012 | Hochstrate et al. | |
| 2012/0137562 | A1 | 6/2012 | Langevin et al. | |
| 2012/0167424 | A1 | 7/2012 | Gomez | |
| 2013/0174457 | A1 | 7/2013 | Gangl et al. | |
| 2013/0219763 | A1 | 8/2013 | Nunes | |
| 2014/0000142 | A1 | 1/2014 | Patel | |
| 2014/0224114 | A1 | 8/2014 | Faxon | |
| 2014/0230297 | A1 | 8/2014 | Larson et al. | |
| 2014/0331535 | A1 | 11/2014 | Robinson et al. | |
| 2014/0352191 | A1 | 12/2014 | Fritz et al. | |
| 2015/0000171 | A1 | 1/2015 | Roberts | |
| 2015/0020426 | A1 | 1/2015 | Neergaard | |
| 2015/0101230 | A1 | 4/2015 | Curtis | |
| 2016/0054085 | A1 | 2/2016 | Miller, III | |
| 2016/0327357 | A1 | 11/2016 | Wheatley | |
| 2017/0082385 | A1 | 3/2017 | Orne, III et al. | |
| 2017/0160026 | A1 | 6/2017 | Walther et al. | |
| 2017/0299303 | A1 | 10/2017 | Phipps et al. | |
| 2018/0087859 | A1 | 3/2018 | Underwood et al. | |
| 2018/0347924 | A1 | 12/2018 | Satern | |
| 2019/0049203 | A1* | 2/2019 | Song | F41A 3/66 |
| 2019/0086168 | A1 | 3/2019 | Song et al. | |
| 2019/0226779 | A1 | 7/2019 | DiChario et al. | |
| 2021/0270551 | A1 | 9/2021 | Underwood et al. | |

* cited by examiner

POLYMER FIREARM RECEIVER

CROSS REFERENCE TO RELATED APPLICATION

This application is related to and claims priority benefit from U.S. Provisional Application No. 63/172,290 ("the '290 application"), filed on Apr. 8, 2021 and entitled "POLYMER FIREARM RECEIVER." The '290 application is hereby incorporated in its entirety by this reference.

FIELD OF THE INVENTION

The field of the invention relates to firearms, particularly receivers for firearms where the receiver is a polymer material.

BACKGROUND

Many modern firearms and firearm accessories (including handguns, rifles, carbines, shotguns, etc.) are designed based on existing modular firearm systems. For example, many firearms and related accessories are designed for compatibility with the AR-15 variant (civilian) or M16/M4 (military) firearm platform (i.e., collectively, AR-15 style firearms). Many of these products follow traditional designs based on industry standards and/or military specification (milspec).

Consumers often prefer to manufacture their own receiver for an AR-15 style firearm, as opposed to purchasing a receiver. In some cases, the consumer may purchase a receiver blank (often referred to as an 80% receiver) that does not meet the definition of a "firearm" and thus are not subject to regulation under the Gun Control Act (GCA) according to the Bureau of Alcohol, Tobacco, Firearms and Explosives. In some cases, the receiver blank is partially manufactured such that the fire-control cavity area is completely solid and/or un-machined such that the receiver blank has not reached the "stage of manufacture" which would result in the classification of a firearm according to the Bureau of Alcohol, Tobacco, Firearms and Explosives' interpretation of the GCA.

To increase access to firearms and convenience for a greater number of operators while reducing the cost and complexity associated with manufacturing a receiver for the consumer, it may be desirable to design new firearm receivers with polymer materials that can be easily manufactured from receiver blanks.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a receiver blank comprises: a receiver body comprising a magazine well; and an insert, wherein: the insert is located internal to the receiver body; the insert is manufactured before the receiver body; and the insert must be removed from the receiver body to convert the receiver blank to a firearm receiver.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments in FIGS. 1A-8 show components of various semi-automatic or automatic rifles, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm, .22 Long Rifle; and shotgun calibers such as, for example, 12 gauge, 20 gauge, 28 gauge, .410 gauge, 10 gauge, 16 gauge. The illustrated embodiments focus on a lower receiver for the AR-15 variant (civilian) or M16/M4 (military) firearm platform (i.e., AR-15 style firearms), however, the concepts and features described herein can be are also applicable (with potential necessary alterations for particular applications) to other components of AR-15 style firearms and to components of other firearms. For example, the features and methods related to the receivers and receiver blanks described herein may be applicable to receivers for handguns.

Figure 1A:
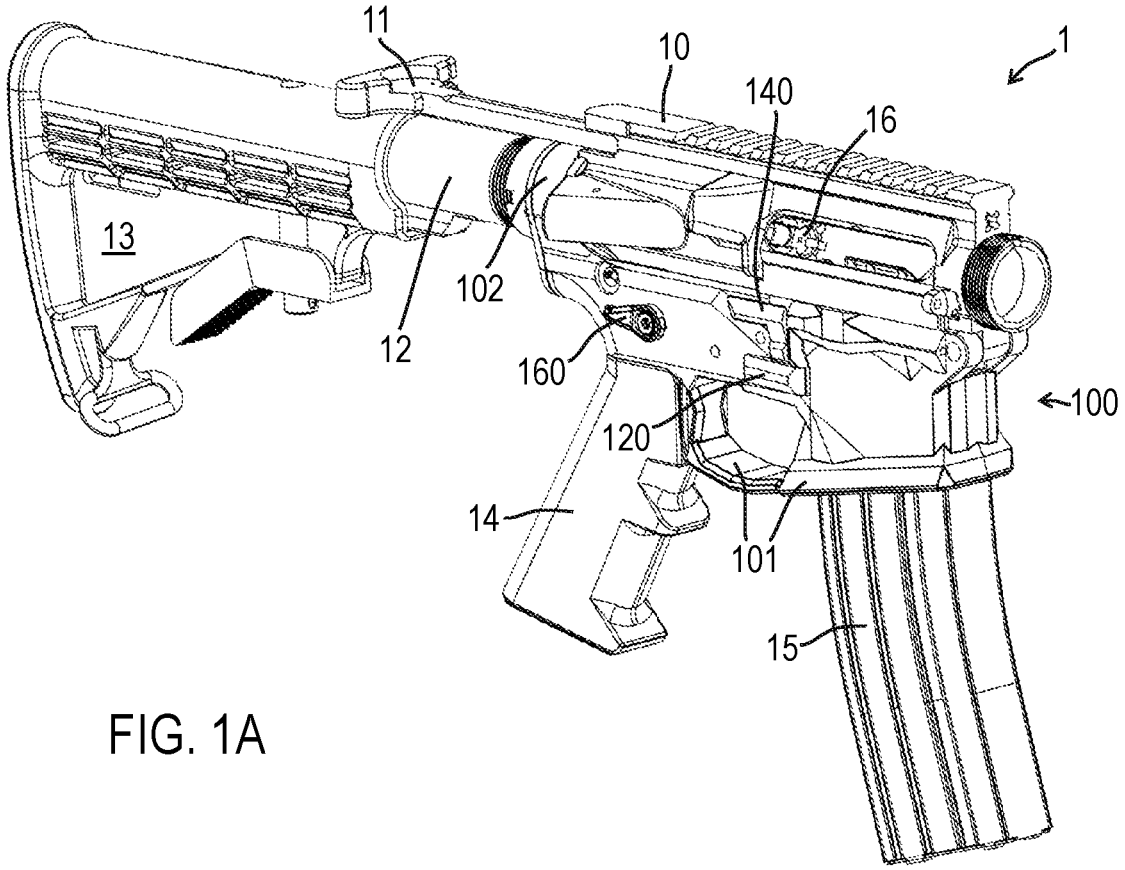
FIG. 1A is a front right perspective view of a firearm according to certain embodiments of the present invention.
Figure 1B:
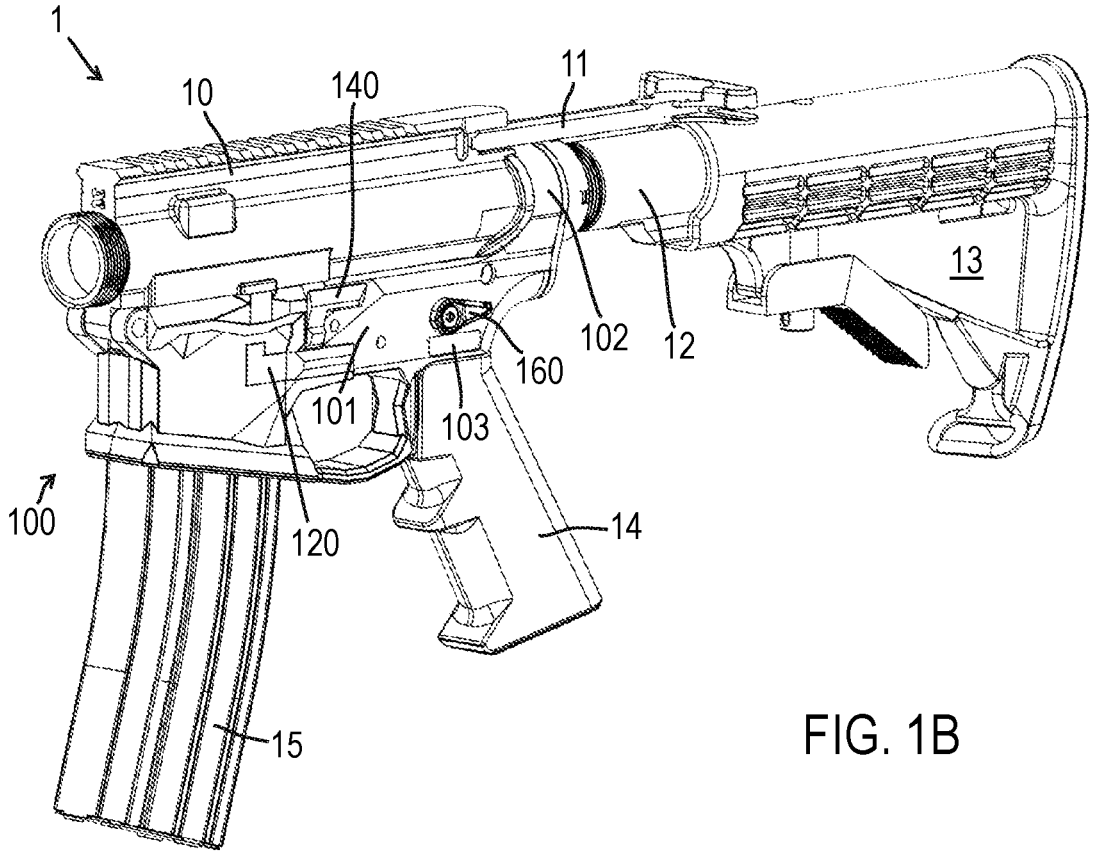
FIG. 1B is a front left perspective view of the firearm of FIG. 1A.

In some cases, a firearm 1 includes a receiver assembly 100, an upper receiver 10, a charging handle 11, a buffer tube 12, a stock 13, a grip 14, a magazine 15, and a bolt carrier group 16 (see FIGS. 1A and 1B). Other components, including, for example, a barrel, a fire control group, and a handguard, are not illustrated for simplicity.

Figure 3A:
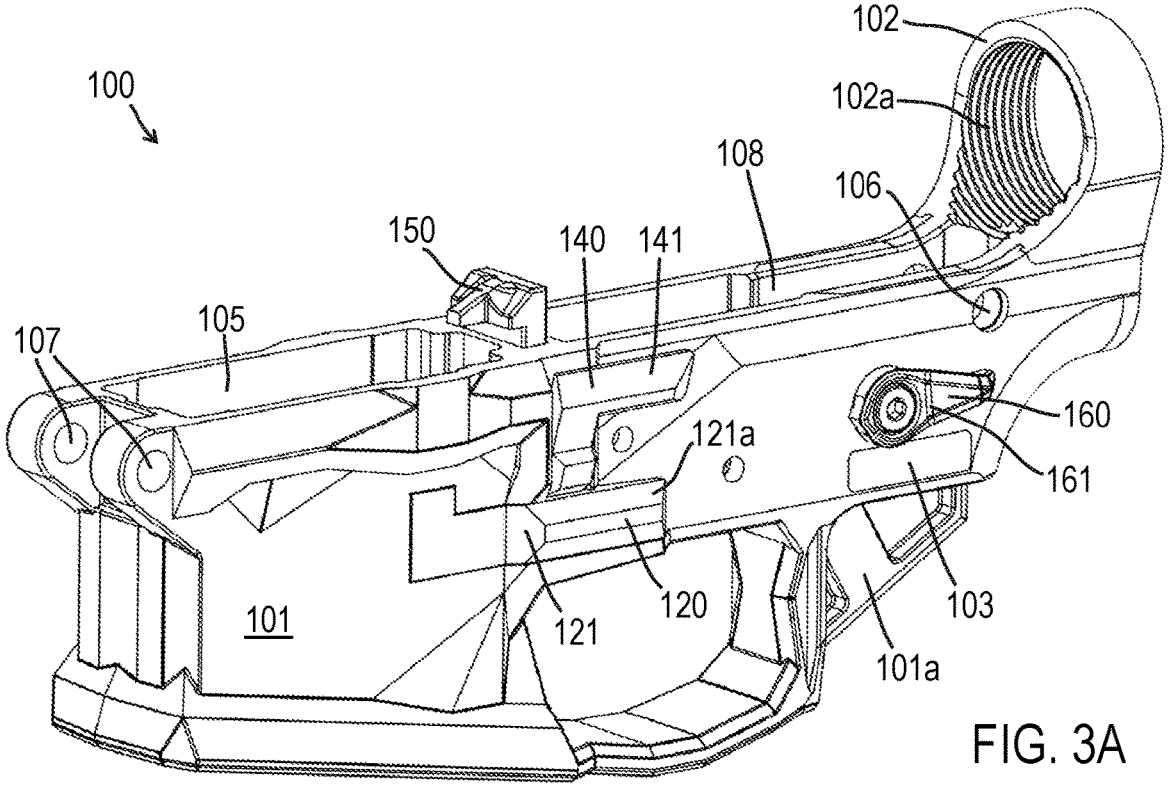
FIG. 3A is a front left perspective view of a receiver assembly of the firearm of FIG. 1A.
Figure 3B:
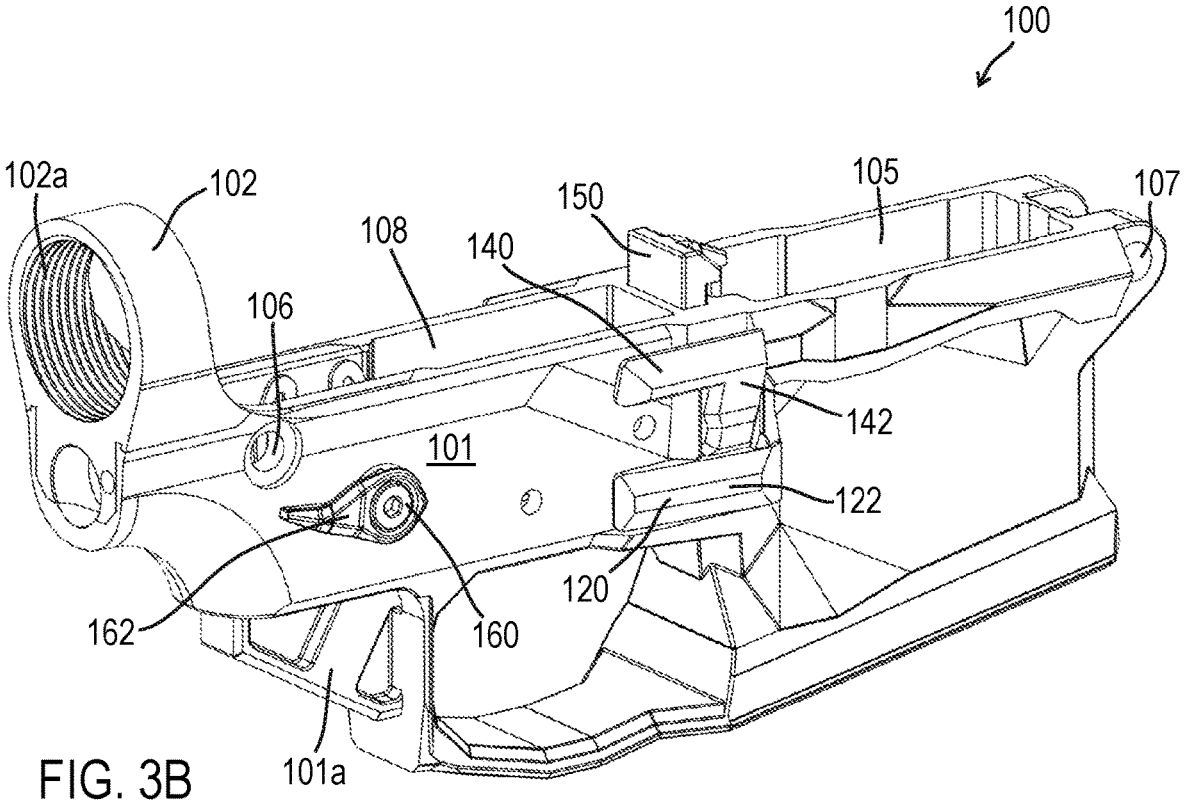
FIG. 3B is a rear right perspective view of the receiver assembly of FIG. 3A.
Figure 4:
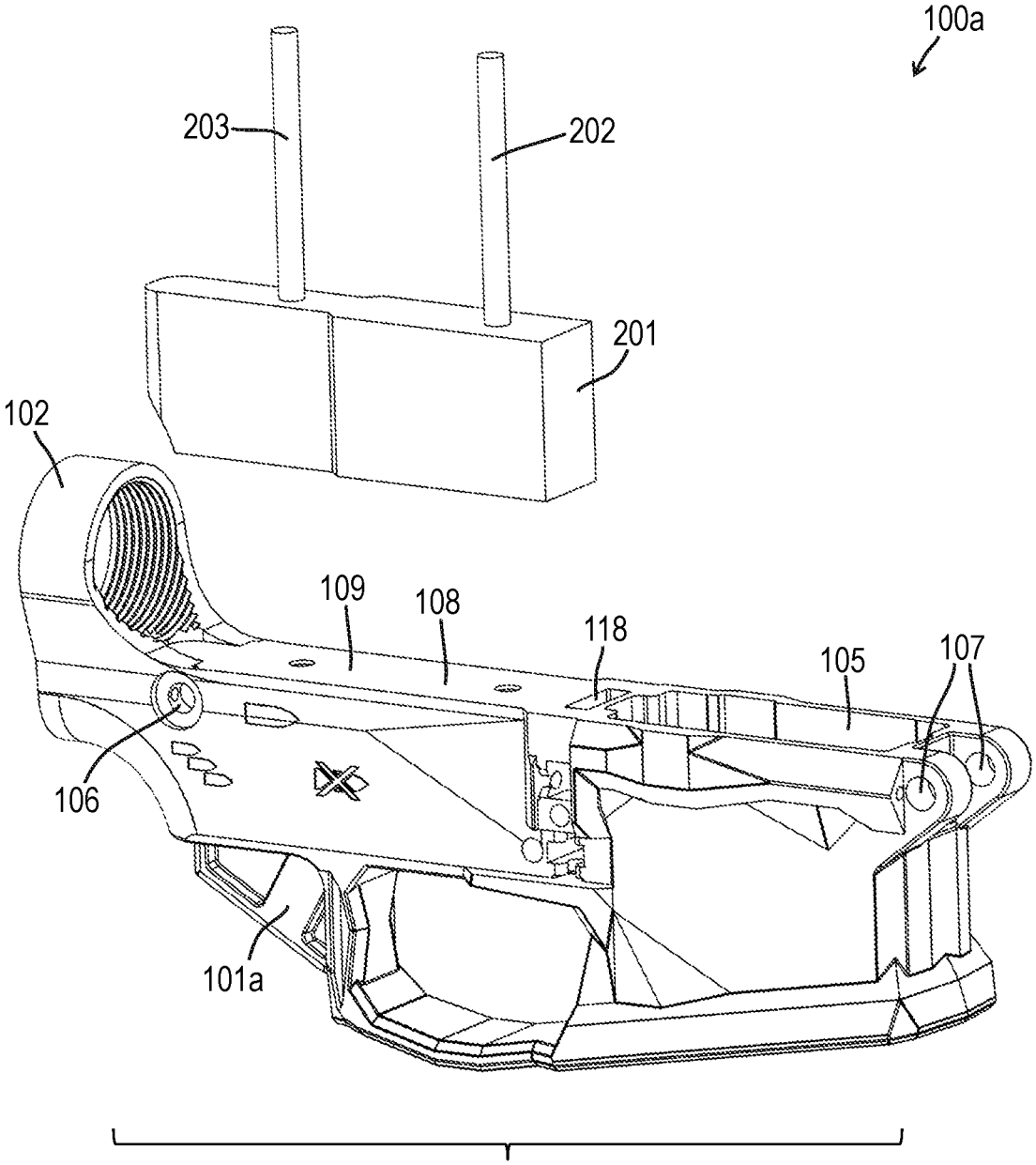
FIG. 4 is an exploded perspective view of the receiver blank of FIG. 2.
Figure 5A:
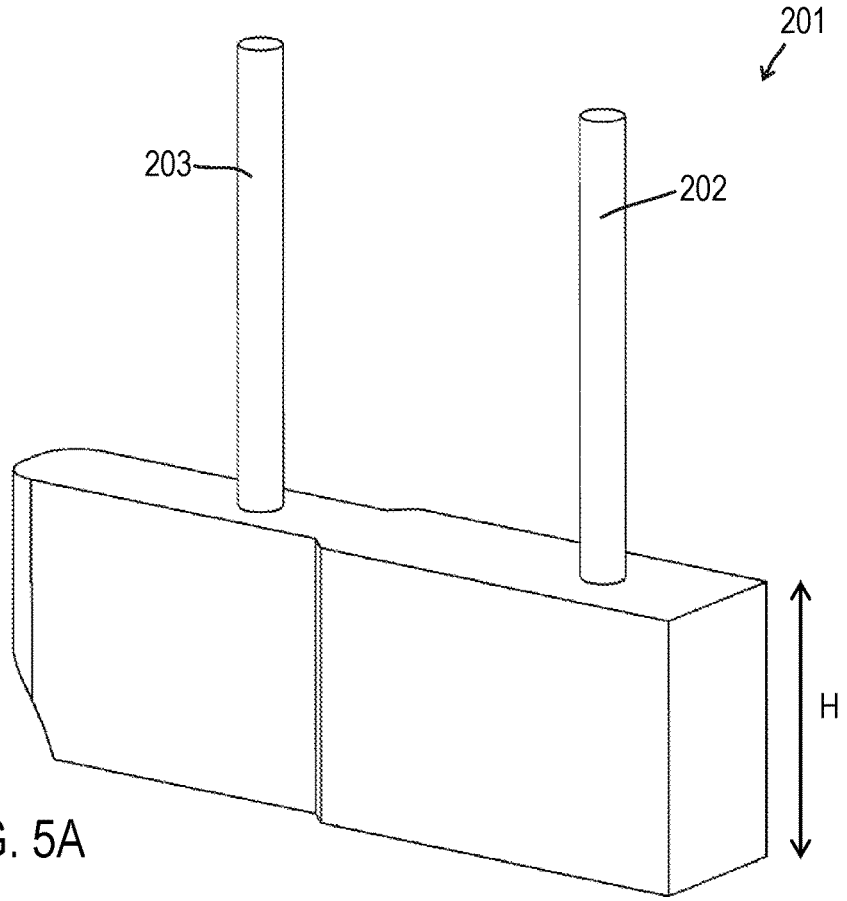
FIG. 5A is a front right perspective view of an insert of the receiver blank of FIG. 2.
Figure 5B:
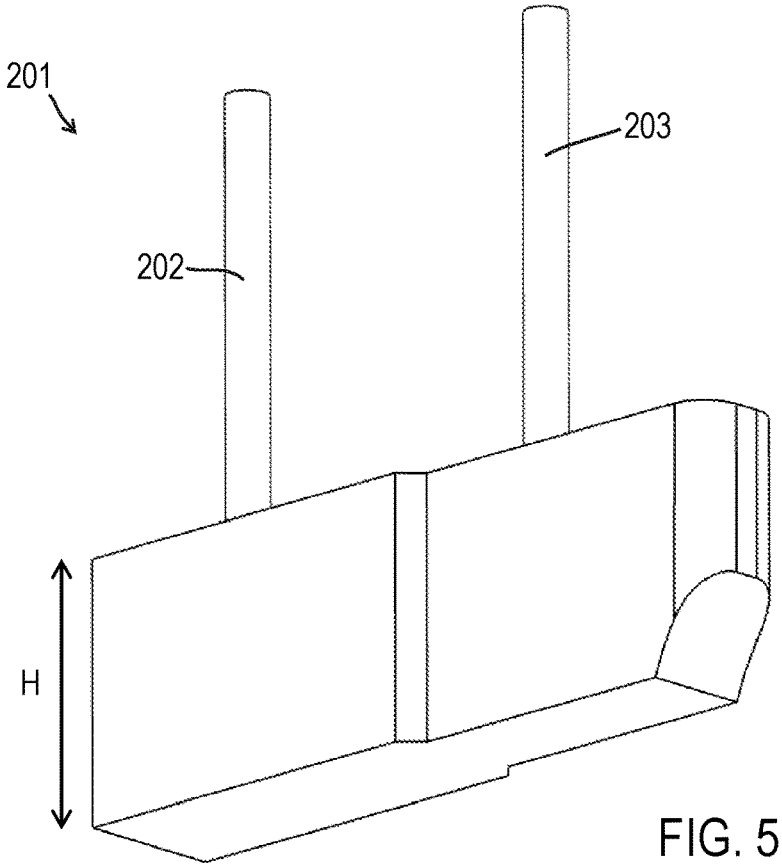
FIG. 5B is a rear left perspective view of the insert of FIG. 5A.
Figure 5C:
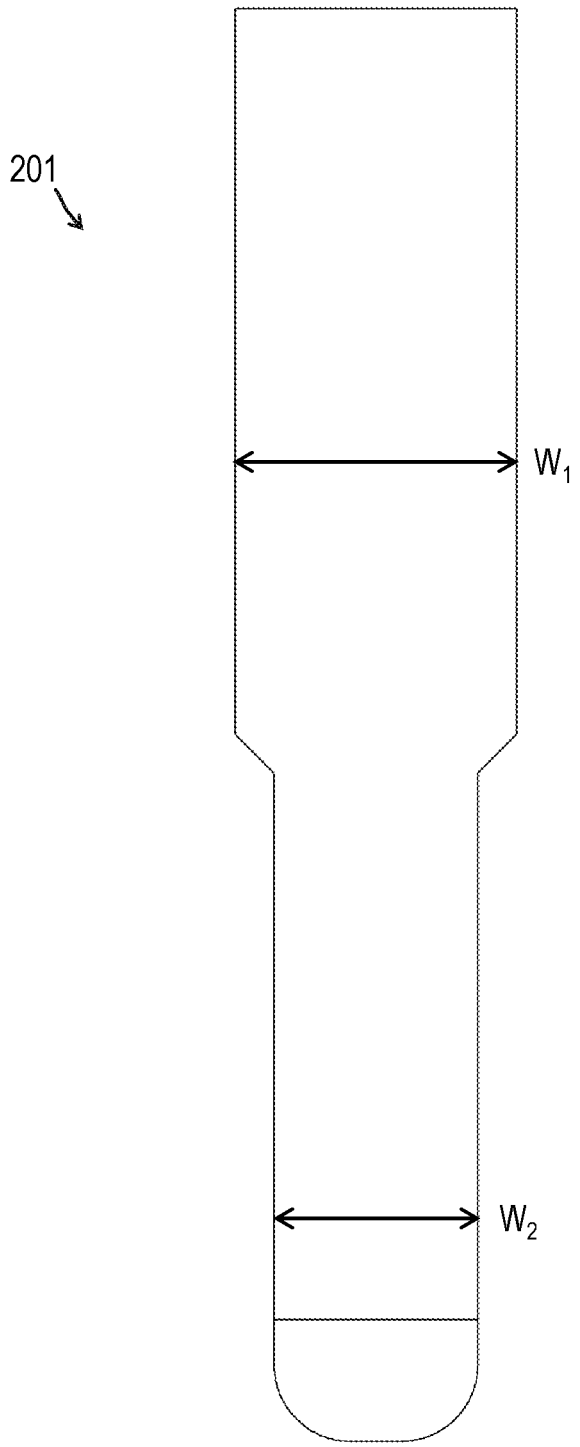
FIG. 5C is a bottom view of the insert of FIG. 5A.

According to certain embodiments of the present invention, as shown in FIGS. 1A-1B, the receiver assembly 100 may include a magazine release assembly 120, a bolt release assembly 140, and a safety selector assembly 160. As shown in FIGS. 3A-4, the receiver assembly 100 may also include a receiver body 101, a threaded mount 102, a magazine well 105, a fire-control cavity 108, and an insert 201. In some embodiments, the receiver assembly 100 interfaces with the upper receiver 10 with two pinned connections including an interface at a takedown pin hole 106 and at a pivot pin hole 107. The takedown pin hole 106 may extend through both the receiver body 101 and the threaded mount 102. The magazine 15 may be capable of being inserted into the magazine well 105 (see FIGS. 1A-2B). In some embodiments, the magazine 15 is a Standardization Agreement (STANAG) magazine (designed for 5.56×45 mm NATO and/or .223 Remington ammunition), a magazine designed for 7.62×35 mm (.300 AAC Blackout), a SR-25 pattern magazine (designed for 7.62×51 mm NATO and/or .308 Winchester ammunition), a STANAG magazine designed for alternative calibers (e.g., pistol calibers including, for example, 9×19 mm, .45 ACP, .40 S&W, .380 ACP, 10 mm Auto, 5.7×28 mm, .22 Long Rifle, etc.), or any other appropriate magazine. The grip 14 may attach to a grip interface portion 101*a* of the receiver body 101. In some embodiments, the grip 14 may be an integral component of the receiver body 101.

The threaded mount 102 may be an integral portion of the receiver body 101 or may be a separate component. In some embodiments, the threaded mount 102 is an integral component of the receiver body 101 where the receiver body 101 is a non-metallic material (e.g., a polymer material, a plastic material, a composite material, or any appropriate non-metallic material). In other embodiments, the threaded mount 102 and the receiver body 101 are different materials. For example, the threaded mount 102 may be a metallic material and the receiver body 101 may be a non-metallic material.

There are advantages for polymer materials when used for firearm receivers including reduced weight, reduced manufacturing cost/complexity, increased ductility/flexibility, among others. In addition, for embodiments that include polymer materials for some portion(s) of the receiver assembly 100, the polymer material may improve some characteristics of the firearm 1. For example, compared to some metallic materials (such as aluminum), the polymer material may absorb and dissipate more energy and/or vibration. This results in less energy transferred from the chamber of the firearm (where the cartridge is fired) to the operator (i.e., less recoil). Consequently, after firing a round, the operator can more quickly acquire subsequent targets, which results in greater accuracy for additional shots fired. In other words, some of the energy from firing the cartridge is absorbed in receiver body 101 without being transferred to the operator (where conventional metallic receivers will transfer a greater percentage of the energy to the operator).

Figure 2:
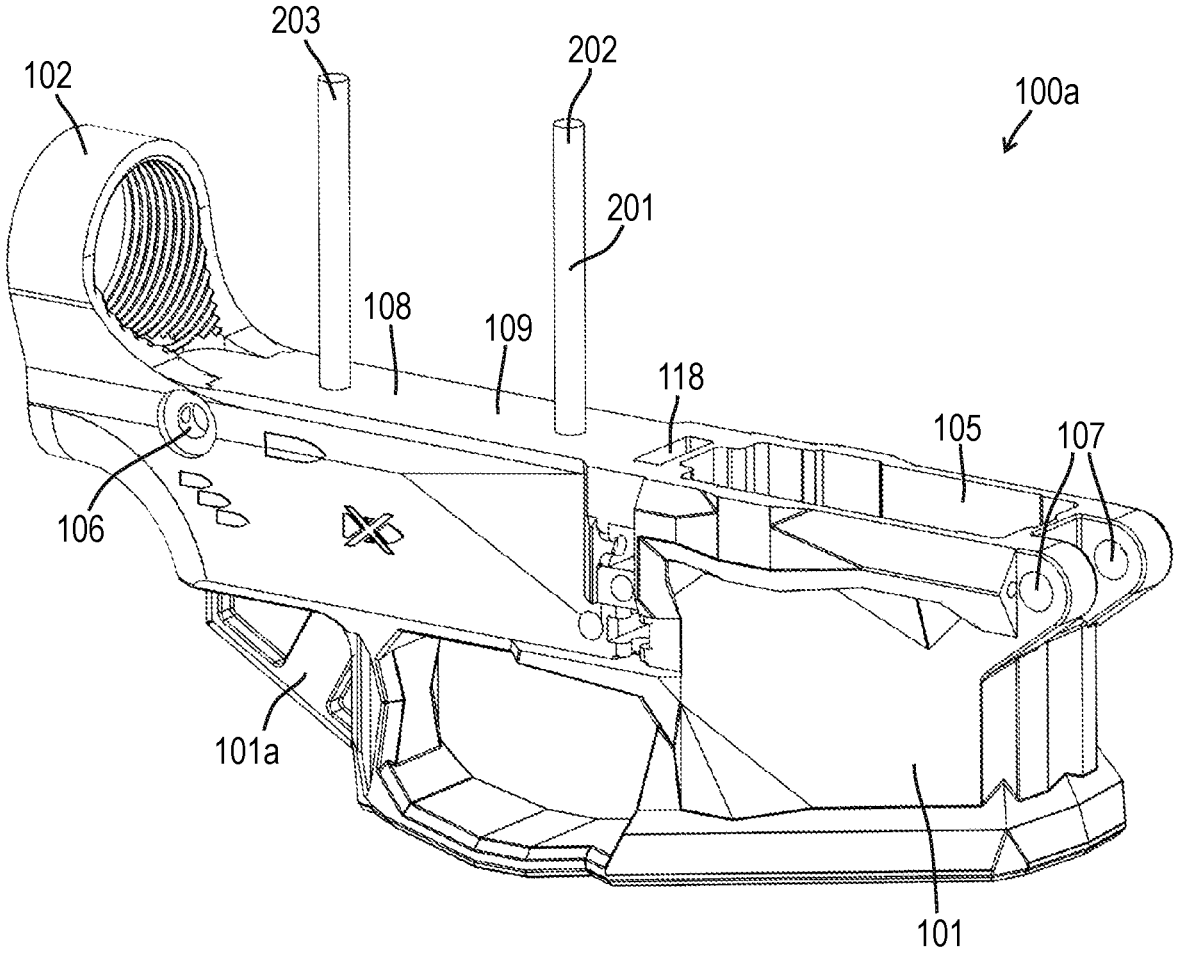
FIG. 2 is a front right perspective view of a receiver blank of the firearm of FIG. 1A.

As shown in FIG. 2, in some embodiments, the receiver body 101 is manufactured as a receiver blank 100*a* that is partially manufactured such that the fire-control cavity 108 is completely solid. In some embodiments, the receiver body 101 is injection molded in a single manufacturing process (i.e., raw polymer material is injected into a mold to produce a product similar to receiver body 101 shown in FIG. 2). However, those experienced with injection molding understand that the volume of material associated with the fire-control cavity 108 portion of this component may lead to sink problems caused by varying cooling rates of the material. Such sink problems may lead to deformation of the receiver body 101, surface defects, collapsed areas, and/or various other problems.

A solution to these sink problems is to create an insert (e.g., insert 201) that corresponds to part or all of the internal space of the fire-control cavity 108. The insert 201 may be molded first (in a separate mold) before being inserted into the mold for the receiver body 101. The receiver body 101 may then be co-molded or overmolded relative to the insert 201. The result is a receiver body 101 where the fire-control cavity 108 is completely solid such that the receiver body 101 is a receiver blank 100*a* (not a firearm). In other words, the resultant receiver body 101 is indistinguishable from a receiver blank 100*a* molded in a single step and avoids sink issues. As shown in FIGS. 2, 4-5B, 6A, and 6B, the insert 201 may include at least one protrusion. In some embodiments, the insert 201 includes a first protrusion 202 and a second protrusion 203. The at least one protrusion 202, 203 may be used to locate the insert 201 relative to the tooling (e.g., the mold for the receiver body 101).

The receiver assembly 100 and/or the receiver blank 100*a* may include provisions for adding a serial number (i.e., to comply with legal requirements and/or for a user customization). In some cases, the receiver assembly 100 or the receiver blank 100*a* includes a specified portion 103 for serialization. The portion 103 may be part of the threaded mount 102, part of the receiver body 101, a separate plate that is neither part of the threaded mount 102 nor part of the receiver body 101, and/or any other appropriate configuration. When the portion 103 is a separate plate, the portion 103 may be metallic, polymer, and/or any other appropriate material.

The insert 201 may be made from the same material as the receiver body 101. For example, the insert 201 and the receiver body 101 may each be made from a polymer material including, for example, plastic, thermoplastic, nylon, polyetherimide, polyoxymethylene (acetal), polytetrafluoroethylene, polyethylene, polypropylene, polyvinyl chloride, polystyrene, carbon composite, and/or other plastic or polymer materials. In some embodiments, the insert 201 is made from the same material and has the same color as the receiver body 101 such that the components are indistinguishable after the receiver body 101 is molded. In other embodiments, the insert 201 is the same material but is a different color than the receiver body 101. A different color material may aid the consumer in removing the material within the fire-control cavity 108 when manufacturing his/her receiver. In some embodiments, the insert 201 is smaller than the appropriate dimensions for the fire-control cavity 108. The insert 201 may have a height H, a width $W_1$, and width $W_2$ where one or more of these dimensions are smaller than the correct/desired dimensions of the fire-control cavity 108. In other words, the consumer would need to remove all of the material of the insert 201 and some of the material of the receiver body 101 to manufacture a receiver. For example, if the insert 201 is a different color, the consumer would begin by removing all of the material based on the color of the insert 201 followed by an additional step of removing a precise measured amount of material from the receiver body 101.

Figure 6A:
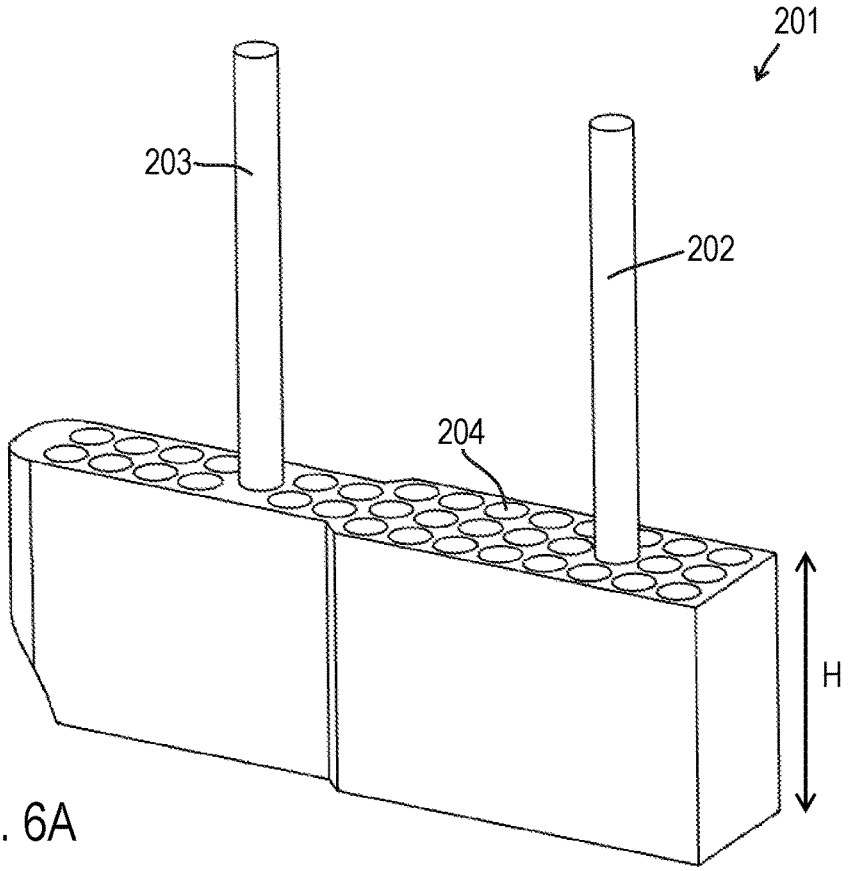
FIG. 6A is a front right perspective view of an insert of the receiver blank of FIG. 2.
Figure 6B:
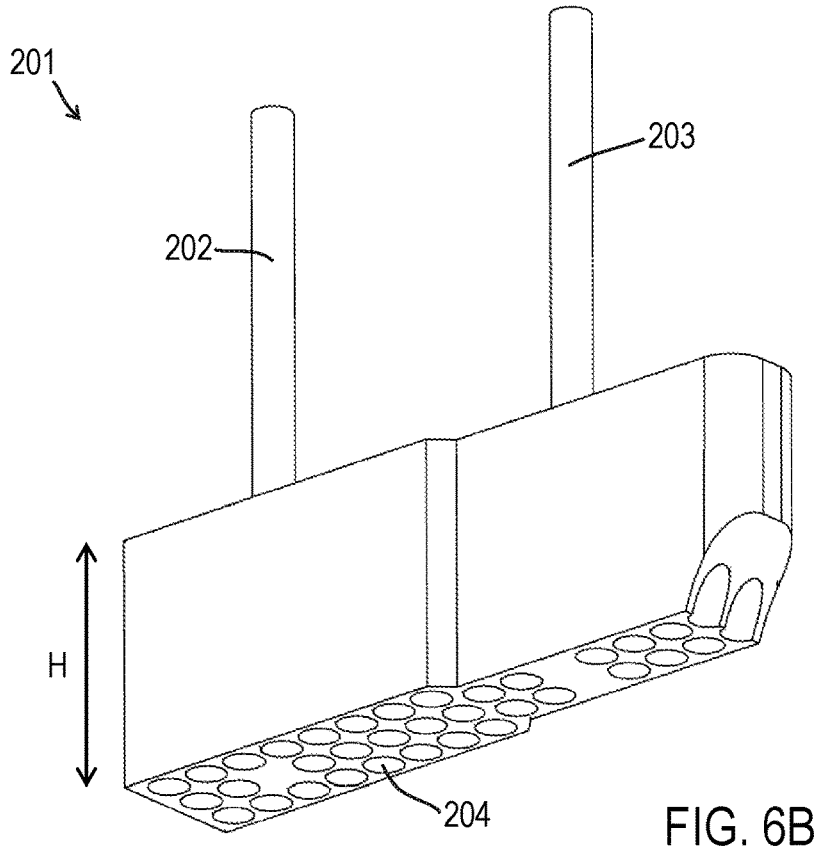
FIG. 6B is a rear left perspective view of the insert of FIG. 6A.
Figure 6C:
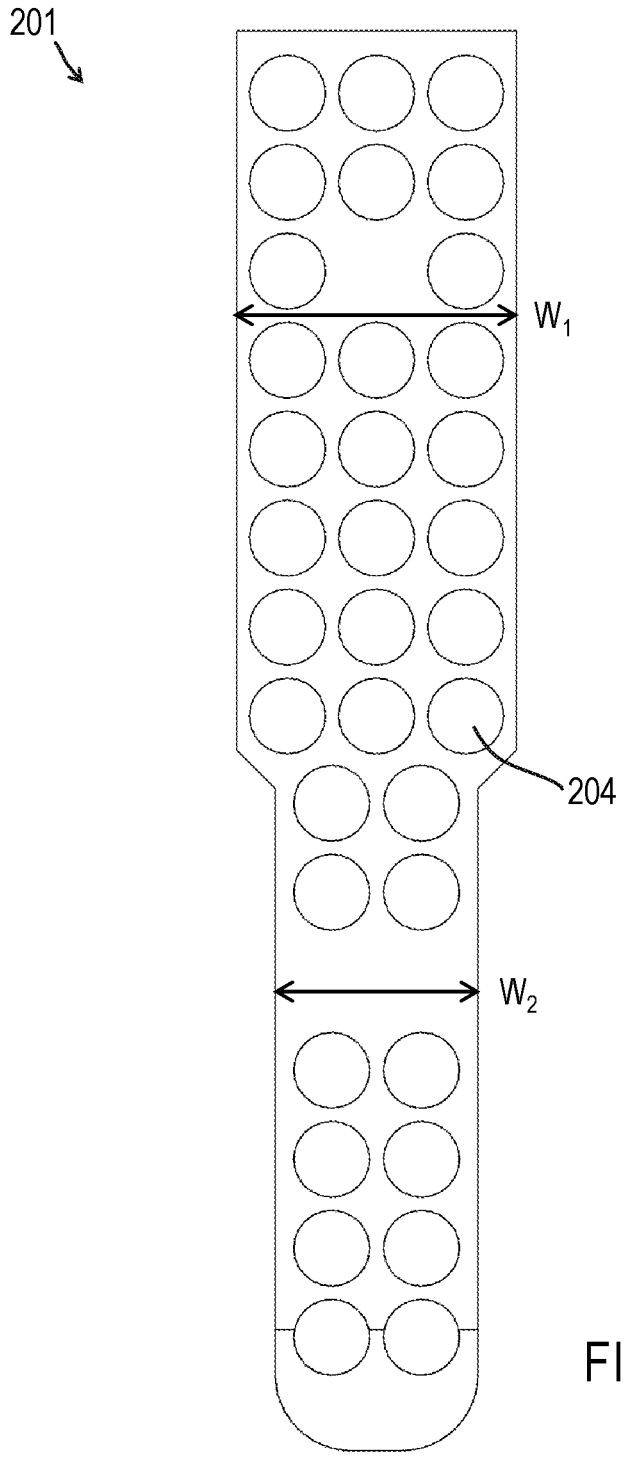
FIG. 6C is a bottom view of the insert of FIG. 6A.

As shown in FIGS. 6A-6C, in some embodiments, the insert 201 is molded with a plurality of holes 204. The holes 204 may end extend vertically through the insert 201. The holes 204 may be included to minimize wall thickness of the insert 201 which reduces the likelihood of sink issues when molding the insert 201. In some cases, the holes 204 extend through the full height of the insert 201. The holes 204 may be blind holes that stop short of either the bottom or the top of the insert 201. In other embodiments, the insert 201 includes a solid portion at the center (approximately halfway in the height H direction) such that the holes 204 include blind holes from the top and blind holes from the bottom. After the insert 201 is located in the mold of the receiver body 101 and material (e.g., polymer) is inserted into the mold, the material of the receiver body 101 flows into and fills the holes 204. The resulting cylinders of the receiver body 101 ensure sufficient engagement between the insert 201 and the receiver body 101.

In some embodiments, the insert 201 is a different material from the receiver body 101. The receiver body 101 may be a polymer material including, for example, plastic, thermoplastic, nylon, polyetherimide, polyoxymethylene (acetal), polytetrafluoroethylene, polyethylene, polypropylene, polyvinyl chloride, polystyrene, carbon composite, and/or other plastic or polymer materials. In some cases, the insert 201 is a different material with different properties than the material of the receiver body 101. For example, the insert 201 may be a polyvinyl alcohol thermoplastic, a polyvinyl acetal, Elvanol®, Mowiflex™, and/or any water-soluble synthetic polymer. In cases where the insert 201 is water soluble, a consumer may apply water to the receiver body 101 to remove the insert 201 (e.g., soaking or spraying the receiver with water). The resulting portion of the receiver body 101 may still require the consumer to remove material to fully manufacture the receiver. For example, the consumer may need to remove an upper surface 109 of the fire-control cavity 108. The receiver body 101 may also include a plurality of vertical (cylindrical) protrusions within the fire-control cavity 108 corresponding to the holes 204 which the consumer would need to remove to fully manufacture the receiver. As discussed above, the width ($W_1$ and/or $W_2$) may be smaller than the desired size of the fire-control cavity 108 such that the consumer would need to remove a portion of the side walls of the receiver body 101.

The receiver assembly 100, the receiver body 101, the insert 201, and the other components described herein may be manufactured in various different ways. In some embodiments, a method of manufacturing a receiver blank 100*a* includes molding an insert 201 by injecting liquified polymer into a first mold or cavity followed by locating the insert 201 in a second mold or cavity and co-molding or overmolding a receiver body 101 relative to the insert 201 (injecting liquified polymer) in the second mold or cavity to create the receiver blank 100*a*. In some cases, the molding machine may include a first cavity for the insert 201 and a second cavity for overmolding the receiver body 101 relative to the insert 201. In other embodiments, the insert 201 is formed in a first mold before being removed and inserted into a second separate mold for overmolding the receiver body 101 relative to the insert 201. As shown in FIGS. 4-6C, the insert 201 may approximately correspond to the interior shape of the fire-control cavity 108. In some cases, one or more of the dimensions of the insert 201 (e.g., height H, a width $W_1$, and/or width $W_2$) are less than the corresponding final dimension of the fire-control cavity 108. The insert 201 may include at least one protrusion 202, 203 which engage a corresponding feature in the second mold to locate the insert 201 within the second mold. As shown in FIGS. 6A-6C, the insert 201 may include a plurality of holes 204 such that polymer in the second mold flows into the holes and forms cylinders extending vertically through the fire-control cavity 108. In some cases, the insert 201 is molded with holes 204 to reduce wall thickness of the insert 201, which results in fewer sink problems (as described above). The output from the second mold may be a receiver blank 100*a* where the fire-control cavity 108 is filled with material that must be removed before a fire control group can be installed (i.e., see FIG. 2).

In some embodiments, the manufacturing process continues after the receiver blank 100*a* has been sold to a consumer and the consumer begins the necessary additional steps to manufacture the receiver assembly 100. The consumer will need to remove a volume of material corresponding to the fire-control cavity 108. This volume may correspond to the insert 201, or in other cases, this volume may be larger than the insert 201 (i.e., the consumer would need to remove the insert and some material of the receiver body 101).

The process of removing the material corresponding to the fire-control cavity 108 may include using appropriate tools to cut away the material. The appropriate tools may include one or more of a milling machine, a drill press, a plunge router, a fixed base router, a trim router, a handheld drill, a rotary tool, a chisel, and/or any other appropriate tool for cutting or removing material. In some embodiments, at least a portion of the fire-control cavity 108 (i.e., the insert 201) is made from a water soluble material. For example, the insert 201 may be a polyvinyl alcohol thermoplastic, a polyvinyl acetal, Elvanol®, Mowiflex™, and/or any water-soluble synthetic polymer. In cases where the insert 201 is water soluble, a consumer may apply water to the receiver body 101 to remove the insert 201 (e.g., soaking or spraying the receiver with water). The resulting portion of the receiver body 101 may still require the consumer to remove material to fully manufacture the receiver. For example, the consumer may need to remove an upper surface 109 of the fire-control cavity 108. The receiver body 101 may also include a plurality of vertical (cylindrical) protrusions within the fire-control cavity 108 corresponding to the holes 204 which the consumer would need to remove to fully manufacture the receiver. As discussed above, the width ($W_1$ and/or $W_2$) may be smaller than the desired size of the fire-control cavity 108 such that the consumer would need to remove a portion of the side walls of the receiver body 101. In addition, the consumer would need to accurately drill holes for the fire control group and the safety selector assembly 160.

Figure 7:
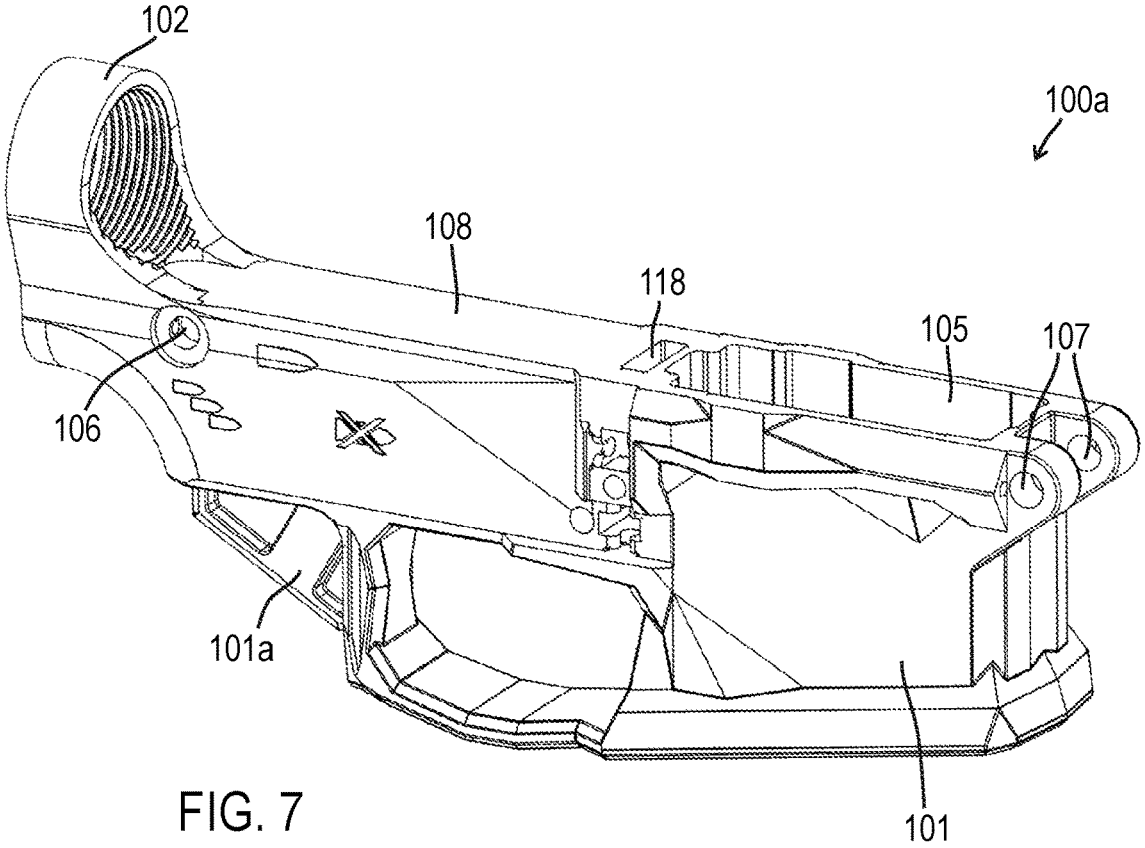
FIG. 7 is a front right perspective view of a receiver blank of the firearm of FIG. 1A.
Figure 8:
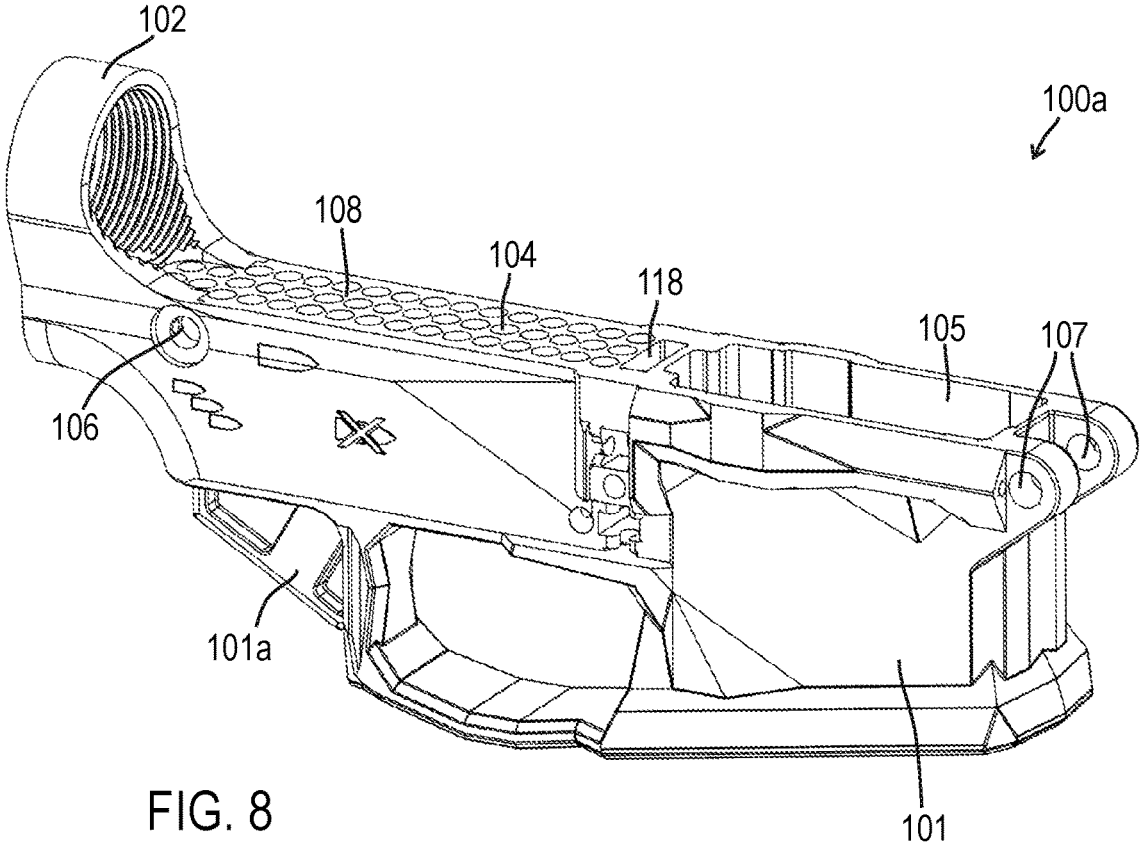
FIG. 8 is a front right perspective view of a receiver blank of the firearm of FIG. 1A.

In other embodiments, the receiver blank 100*a* is created using a single mold. For example, as shown in FIG. 7, the receiver blank 100*a* may include a completely solid volume in the region of the fire-control cavity 108. In other embodiments, a single mold includes a plurality of cylindrical protrusions or runners that create a pattern of holes 104 in the region of the fire-control cavity 108 (see FIG. 8). This pattern of holes 104 reduces the likelihood of sink problems in the region of the fire-control cavity 108.

In some embodiments, the magazine release assembly 120 includes at least one mechanism for releasing the magazine 15 from the magazine well 105. In particular, the magazine may be released due to movement of the left and/or right side magazine release portions 121, 122. Conventional lower receivers include a button-operated mechanism that releases a magazine based on linear movement where the mechanism can only be operated from the right side of the firearm (designed exclusively for right-handed operators). While the magazine release assembly 120 may include a single mechanism on only one side of the firearm, in some embodiments, the magazine release assembly 120 includes a left side magazine release portion 121 and a right side magazine release portion 122 such that the magazine release assembly 120 is fully ambidextrous. In some embodiments, the left and/or right side magazine release portions 121, 122 may each include a lever mechanism while in other embodiments, the magazine release assembly 120 includes other modes of operation including, for example, electronic, gear-driven, belt-driven, linear actuators, other mechanical systems, or any other appropriate type of operation. In other words, the magazine release assembly 120 may include at least one pivoting lever.

The left and/or right side magazine release portions 121, 122 may be metallic components in some embodiments. In other embodiments, at least some portions of the left and right side magazine release portions 121, 122 may be a non-metallic material (e.g., polymer).

In some embodiments, the bolt release assembly 140 includes at least one mechanism for manipulating the bolt carrier group 16. In some cases, the bolt carrier group 16 is biased toward a forward end of the firearm (e.g., by a spring within the buffer tube 12). In certain conditions, the bolt release assembly 140 engages and holds the bolt carrier group 16 in a rear position (see FIG. 1A) where the rear surface of the bolt release central portion 150 engages the forward face of the bolt carrier group 16. The bolt release central portion 150 is at least partially located within the cavity 118 of the receiver body 101, and the bolt release central portion 150 can be raised upward due to interface between the forward protrusion of the bolt release central portion 150 and the follower of the magazine 15 or due to the left and/or right side bolt release portions 141, 142.

Conventional lower receivers include a pivoting mechanism that manipulates a bolt carrier group based on rotational movement where the mechanism can only be operated from the left side of the firearm. While the bolt release assembly 140 may include a single mechanism on only one side of the firearm, in some embodiments, the bolt release assembly 140 includes a left side bolt release portion 141 and a right side bolt release portion 142 such that the bolt release assembly 140 is fully ambidextrous. In some embodiments, the left and/or right side bolt release portions 141, 142 may each include a lever mechanism while in other embodiments, the bolt release assembly 140 includes other modes of operation including, for example, electronic, gear-driven, belt-driven, linear actuators, other mechanical systems, or any other appropriate type of operation. In other words, the bolt release assembly 140 may include at least one pivoting lever.

In some cases, the operator interface portions for raising/lowering the bolt release central portion 150 (left and/or right side bolt release portions 141, 142) are symmetric on each side of the receiver assembly 100. Such a configuration ensures consistent operation and ergonomics for each operator, including both right-hand dominant and left-hand dominant operators. The left and/or right side bolt release portions 141, 142 may be metallic components in some embodiments. In other embodiments, at least some portions of the left and right side bolt release portions 141, 142 may be a non-metallic material (e.g., polymer).

As shown in FIGS. 1A-3, the safety selector assembly 160 may interface with the safety selector hole. The safety selector assembly 160 includes at least one safety portion, and, in some cases, includes a left side safety portion 161 and a right side safety portion 162 such that the safety selector assembly 160 is fully ambidextrous.

The components of any of the firearms 1 and/or the receiver assemblies 100 described herein may be formed of materials including, but not limited to, thermoplastic, carbon composite, plastic, nylon, polyetherimide, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A receiver blank comprising: a receiver body comprising a magazine well; and an insert, wherein: the insert is located internal to the receiver body; the insert is manufactured before the receiver body; and the insert must be removed from the receiver body to convert the receiver blank to a firearm receiver; the receiver body and the insert comprise different materials; and the insert comprises a water-soluble material.

2. The receiver blank of claim 1, wherein the insert comprises at least one protrusion extending away from the receiver body such that the at least one protrusion is visible.

3. The receiver blank of claim 2, wherein the entirety of the insert other than a portion of the at least one protrusion is not visible because the insert is internal to the receiver body.

4. The receiver blank of claim 1, wherein the insert comprises a plurality of holes extending at least partially through the insert.

5. The receiver blank of claim 1, wherein the material of the receiver body and the insert comprises at least one selected from the group of plastic, thermoplastic, nylon, polyetherimide, polyoxymethylene, polytetrafluoroethylene, polyethylene, polypropylene, polyvinyl chloride, polystyrene, or carbon composite.

6. The receiver blank of claim 2, wherein the at least one protrusion comprises a cylindrical shape with a circular cross section.

7. The receiver blank of claim 1, wherein: the receiver body comprises at least one material selected from the group of plastic, thermoplastic, nylon, polyetherimide, polyoxymethylene, polytetrafluoroethylene, polyethylene, polypropylene, polyvinyl chloride, polystyrene, or carbon composite.

8. The receiver blank of claim 1, wherein the shape of the insert approximately corresponds to a fire-control cavity of the firearm receiver.

9. The receiver blank of claim 8, wherein the insert comprises at least one dimension that is smaller than a corresponding dimension of the fire-control cavity.

10. The receiver blank of claim 1, wherein the receiver body is a receiver for a handgun.

11. The receiver blank of claim 1, further comprising a portion for serialization.

12. A method of manufacturing a receiver blank, the method comprising: forming an insert that approximately corresponds to a fire-control cavity of a firearm receiver; forming a receiver body around the insert, wherein: the insert is manufactured before the receiver body; and the insert must be removed from the receiver body to convert the receiver blank to a firearm receiver, wherein the insert comprises a water-soluble material.

13. The method of claim 12, wherein forming the insert comprises injecting liquified polymer into a first cavity.

14. The method of claim 13, wherein forming the receiver body comprises injecting liquified polymer into a second cavity.

15. The method of claim 12, wherein: forming the insert comprises forming at least one protrusion extending from the insert; and forming the receiver body comprises inserting the at least one protrusion into a corresponding feature within a mold for the receiver body.

16. The method of claim 12, wherein the insert comprises a different color than the receiver body.

17. A receiver blank comprising: a receiver body comprising a magazine well; and an insert, wherein: the insert is located internal to the receiver body; the insert is manufactured before the receiver body; the insert comprises at least one protrusion extending away from both the insert and the receiver body such that the at least one protrusion is visible; the at least one protrusion comprises a cylindrical shape with a circular cross section; and the insert must be removed from the receiver body to convert the receiver blank to a firearm receiver.

18. The receiver blank of claim 17, wherein the receiver body and the insert comprise the same material.

19. The receiver blank of claim 17, wherein: the receiver body comprises at least one material selected from the group of plastic, thermoplastic, nylon, polyetherimide, polyoxymethylene, polytetrafluoroethylene, polyethylene, polypropylene, polyvinyl chloride, polystyrene, or carbon composite; and the insert comprises a water-soluble material.

20. The receiver blank of claim 17, wherein the insert comprises at least one material selected from the group of a polyvinyl alcohol thermoplastic, a polyvinyl acetal, or a water-soluble synthetic polymer.

* * * * *